US007014730B2

(12) United States Patent
Cook

(10) Patent No.: US 7,014,730 B2
(45) Date of Patent: Mar. 21, 2006

(54) SELECTIVE CARD DIVERTING

(75) Inventor: Edward J. Cook, Toronto (CA)

(73) Assignee: Longford Equipment International Limited, (CA)

( * ) Notice: Subject to any disclaimer, the term of this patent is extended or adjusted under 35 U.S.C. 154(b) by 84 days.

(21) Appl. No.: 10/227,677

(22) Filed: Aug. 26, 2002

(65) Prior Publication Data

US 2004/0035527 A1 Feb. 26, 2004

(51) Int. Cl.
*B32B 31/00* (2006.01)

(52) U.S. Cl. ..... 156/299; 156/538; 53/447; 53/460; 270/32; 270/58.01

(58) Field of Classification Search ..... 156/297, 156/299, 556–562, 566, 569, 570; 198/418.7, 198/427, 429, 431, 436, 439, 445; 53/152, 53/154, 247, 447, 460, 493; 270/32, 52.14, 270/58.01, 58.06, 58.23, 58.26

See application file for complete search history.

(56) References Cited

U.S. PATENT DOCUMENTS

| | | | | |
|---|---|---|---|---|
| 2,966,251 | A * | 12/1960 | Nussbaum | 198/349 |
| 4,651,983 | A | 3/1987 | Long | 271/35 |
| 5,388,815 | A * | 2/1995 | Hill et al. | 270/32 |
| 5,538,232 | A | 7/1996 | Long | 270/1.03 |

* cited by examiner

*Primary Examiner*—Jeff H. Aftergut
*Assistant Examiner*—John L. Goff
(74) *Attorney, Agent, or Firm*—Dykema Gossett PLLC

(57) ABSTRACT

Cards may be singly fed along a primary lane so that a batch of cards is fed along the primary lane. One or more cards may be selectively diverted from the primary lane to a secondary lane such that only some of the batch of cards are diverted. The cards from the batch in the primary lane and the secondary lane are then affixed to a carrier so that each card of the batch is affixed to the carrier. The diversion may be achieved by a reciprocating gate between the primary lane and the secondary lane and a conveyor running on a bias between the primary lane and the secondary lane at the downstream location of the gate.

16 Claims, 9 Drawing Sheets

SELECTIVE CARD DIVERTING

BACKGROUND OF THE INVENTION

This invention relates to the selective diversion of cards and to marrying cards with carriers.

Cards, such as credit cards, are typically mailed to a client releasably glued to a carrier, such as a letter sheet. In this regard, apparatus has been developed to automatically glue a card to a carrier. However, increasingly it is found that the same client requires two, three, or even four cards. Typically, at present, this results in plural mailings to the client. Plural mailings are more costly and increase the likelihood of client complaints, especially where all mailings do not arrive contemporaneously.

This invention therefore seeks to avoid drawbacks with current apparatus for gluing cards to carriers.

SUMMARY OF INVENTION

With the present invention cards may be singly fed along a primary lane so that a batch of cards is fed along the primary lane. One or more cards may be selectively diverted from the primary lane to a secondary lane such that only some of the batch of cards are diverted. The cards from the batch in the primary lane and the secondary lane are then affixed to a carrier so that each card of the batch is affixed to the carrier. The diversion may be achieved by a reciprocating gate between the primary lane and the secondary lane and a conveyor running on a bias between the primary lane and the secondary lane at the downstream location of the gate.

According to the invention, there is provided a method of marrying cards with carriers, comprising: singly feeding cards along a primary lane so as to feed a batch of cards along said primary lane, said batch of cards comprising a first number of cards; selectively diverting cards from said primary lane to a secondary lane so as to divert from said batch of cards a second number of cards, said second number of cards being less than said first number of cards; affixing cards from said primary lane and from said secondary lane to a carrier so that each card of said batch of cards is affixed to said carrier.

According to another aspect of the present invention, there is provided apparatus for marrying cards with carriers, comprising: a primary lane for feeding cards; a secondary lane for feeding cards diverted from said primary lane; a diversion station whereat cards are selectively diverted from said primary lane to said secondary lane; a processor for: singly feeding cards along a primary lane so as to feed a batch of cards along said primary lane, said batch of cards comprising a first number of cards; at said diversion station, selectively diverting cards from said primary lane to a secondary lane so as to divert from said batch of cards a second number of cards, said second number of cards being less than said first number of cards; a marrying station wherein cards from said primary lane and from said secondary lane are affixed to a carrier so that each card of said batch of cards is affixed to said carrier.

According to a further aspect of the present invention, there is provided a selective card diverter, comprising: a primary lane for feeding cards; a secondary lane for feeding cards diverted from said primary lane; a diversion station comprising a reciprocating gate between said primary lane and said secondary lane and a conveyor running on a bias between said primary lane and said secondary lane at the downstream location of said gate.

Other features and advantages of the invention will become apparent from a review of the following description and accompanying drawings.

BRIEF DESCRIPTION OF DRAWINGS

In the figures that illustrate example embodiments of the invention.

DETAILED DESCRIPTION

Figure 1:
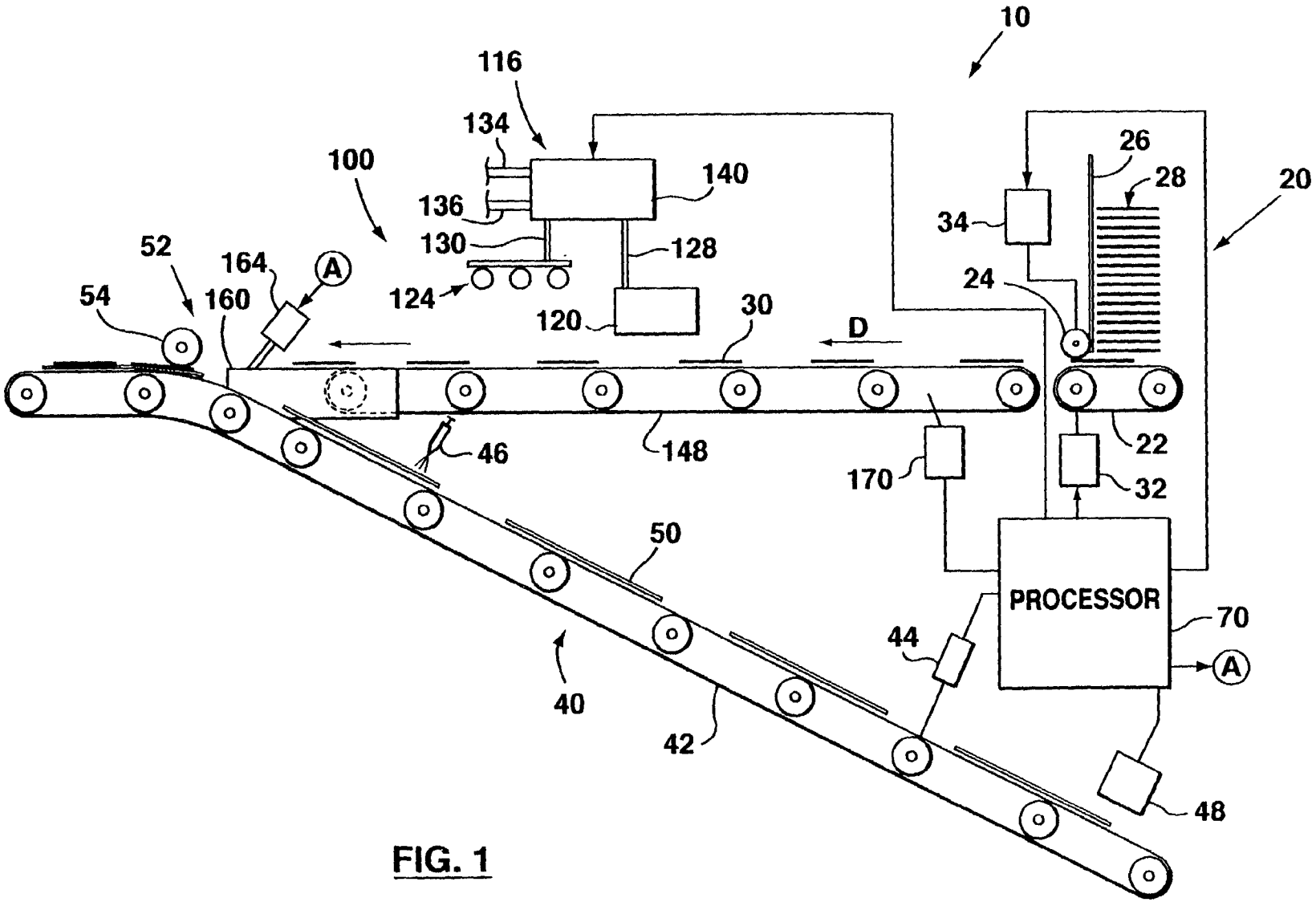
FIG. 1 is a schematic view of a system made in accordance with this invention.

Referring to FIG. 1, a system 10 for marrying cards with carriers, comprises a card feeder 20, apparatus 100 for selectively diverting cards, a carrier conveyor system 40, and a processor 70. The card feeder 20 comprises a feed belt 22, pulsed feed wheel 24 and card guides 26. A stack 28 of cards 30 rests on the feed belt 22. The feed belt 22 and pulsed feed wheel 24 are operated by motors 32, 34, respectively, both under control of the processor 70. Such a card feeder is described more fully in U.S. Pat. No. 4,651,983 to Long, the contents of which are incorporated by reference herein.

The carrier conveyor system 40 comprises conveyor 42 for conveying carriers 50. Conveyor 42 is operated by motor 44 under control of processor 70. Side-by-side glue guns 46 are also operated under control of the processor. A scanner 48, such as a bar code reader overlies the conveyor 42 and outputs to the processor 70. The carrier conveyor 42 extends below the selective card diversion apparatus 100 and inclines toward it so as to reach the exit of the selective card diversion apparatus 100 at a marrying station 52, which includes a nip roller 54.

With reference to FIGS. 2A to 5 along with FIG. 1, the selective card diversion apparatus comprises a primary lane 110 and a secondary lane 112, each of which is for feeding cards 30 singly in a downstream direction D. Cards may be diverted from the primary lane 110 to the secondary lane 112 at a diversion station 116. The diversion station comprises a reciprocating gate 120 positioned between the primary lane and the secondary lane and a lower conveyor 122 and reciprocating upper conveyor 124 running on a bias between the primary lane and the secondary lane at the downstream location of the gate. The upper conveyor 124 comprises three free-wheeling rolls. The lower conveyor is a powered feed belt. When the upper conveyor 124 is extended, it nips the lower conveyor 122.

Gate 120 is mounted to the frame 126 of apparatus 100 by double acting air cylinders 128 and upper conveyor 124 is mounted to the frame 126 by double acting air cylinders 130. The air cylinders 128, 130 are supplied by air supply lines 134, 136 through control valve 140. The control valve has two positions: a first that connects air pressure to the air cylinders 128, 130 in order to extend the gate and retract the upper conveyors and a second that connects air pressure to the cylinders in order to retract the gate and extend the upper conveyors. The control valve is switched between its two positions with a control signal from the processor 70.

Figure 6B:
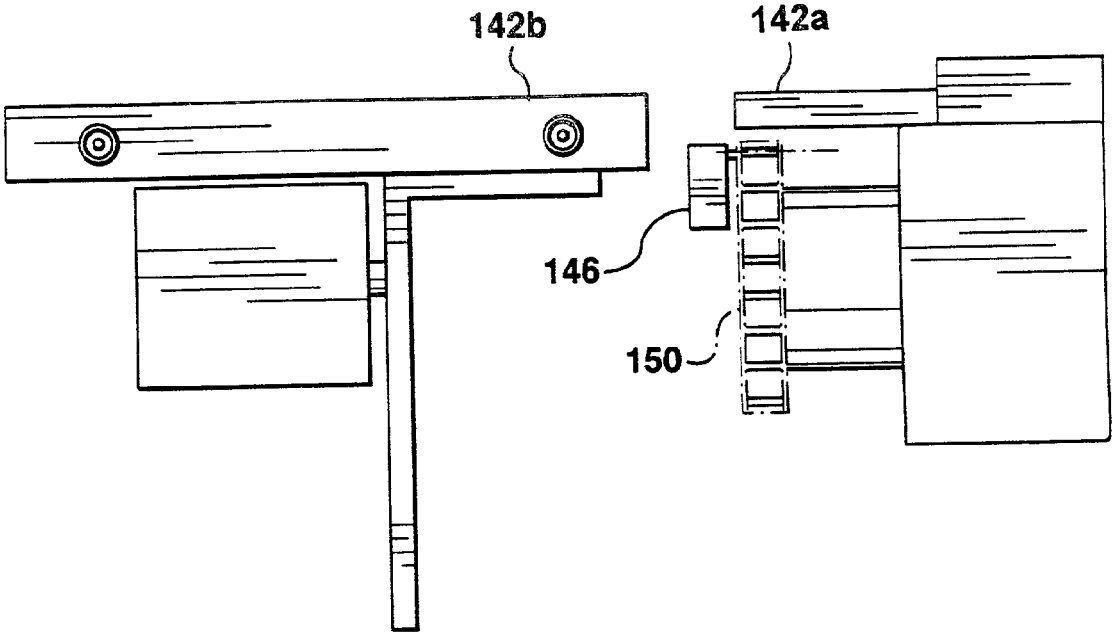
FIGS. 6*a* and 6*b* are schematic front views of a portion of the apparatus of FIG. 3 illustrating its operation.
Figure 6A:
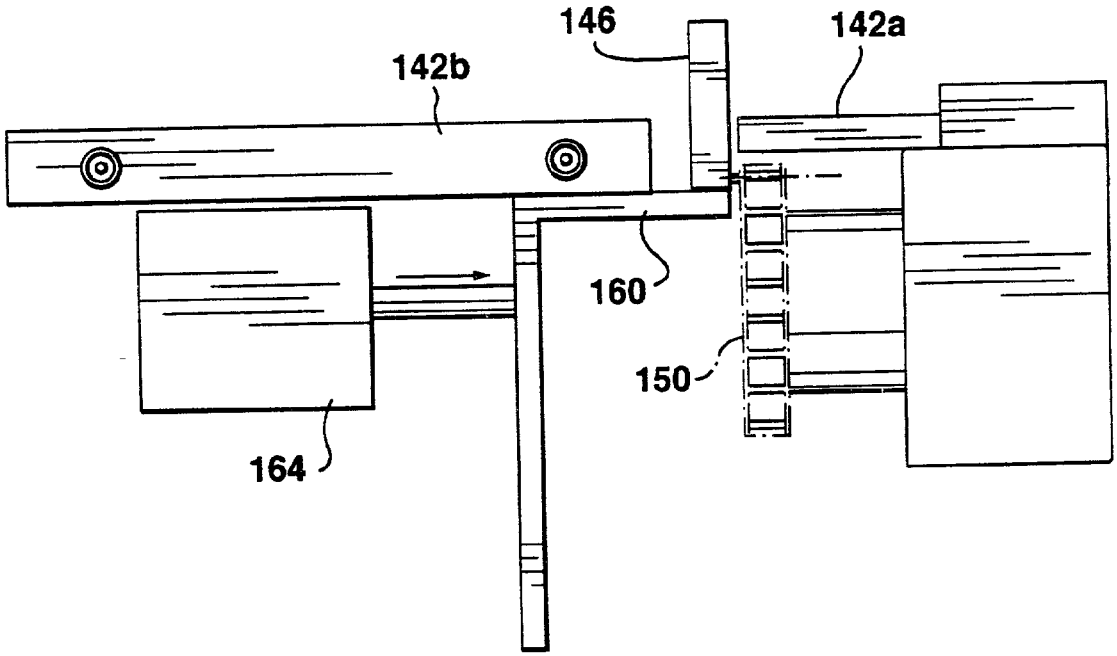
Figure 6C:
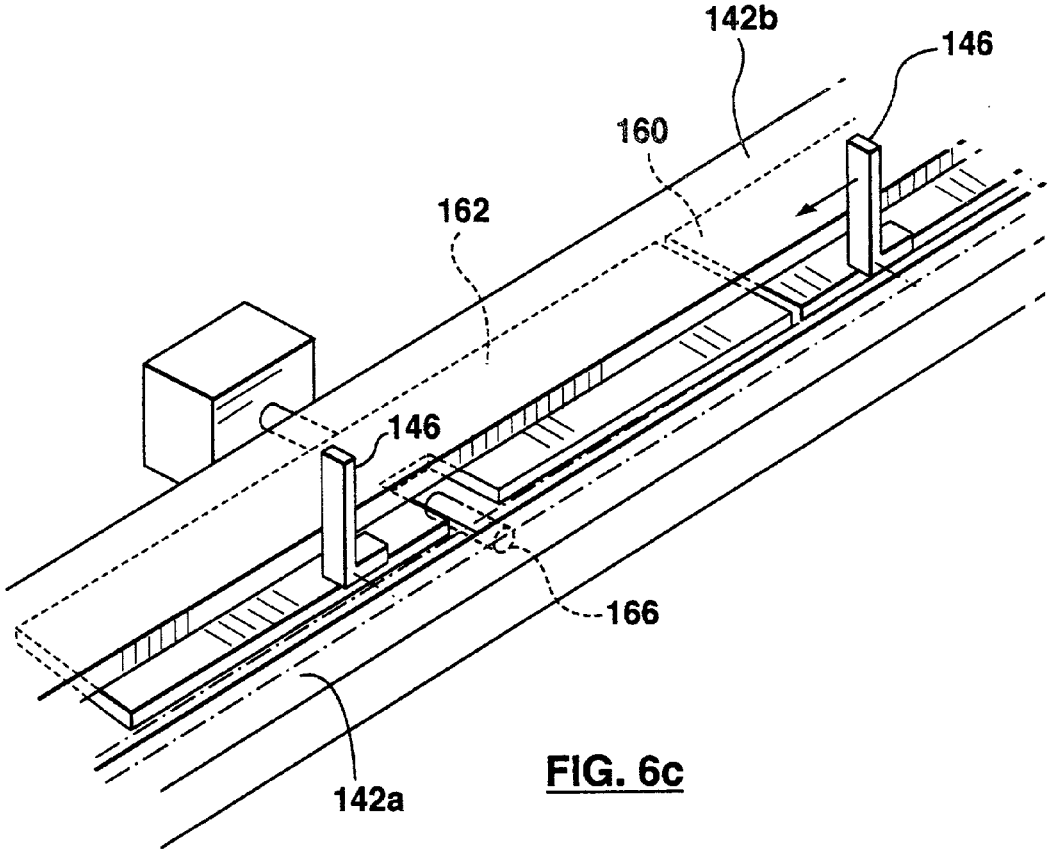
FIGS. 6*c* to 6*e* are perspective views of a portion of the apparatus of FIG. 3 illustrating its operation.

With reference to FIGS. 6*a* and 6*c*, the primary lane may comprise a pair of spaced plates 142*a*, 142*b*. Cards 30 may be moved along the primary lane 110 by a lug conveyor 148 comprising L-shaped lugs 146 running in the gap between the pair of plates 142*a*, 142*b*. The lugs 146 are pivotably joined to an endless chain 150 and held upright by sliding along a support plate 160 extending beneath the gap between the plate pair 142*a*, 142*b*. Support plate 160 ends at diversion station 116 and a reciprocating plate 162 extends downstream of plate 160 to the exit of apparatus 100. The reciprocating plate is reciprocated by a double acting air cylinder 164 under control of the processor 70. The plate 162 has a medial notch 164 that, when the plate 162 is in its extended position, accommodates a peg 166 extending across the gap between the plates 142*a*, 142*b*. The reciprocating plate 162 has a length greater than the length between adjacent lugs 146 of the lug conveyor 148 but short enough so that when a lug 146 is over peg 166, it is the only lug on the plate. Further, the length of the plate is such that the combined length of the upstanding portion of a lug and a card is less than the length between one end of the plate and the medial notch.

The secondary lane 112 may similarly comprise a pair of spaced plates 144*a*, 144*b* and cards 30 may be moved along the secondary lane 112 by lugs 146 of a lug conveyor 158. Unlike the primary lane 110, however, the lug support plate for the secondary lane does not end at the diversion station such that there is no reciprocating lug support plate in the secondary lane.

A motor/rotary encoder 170 operatively connected to the processor 70 may circulate the lugs of the lug conveyors 148, 158 and may circulate lower conveyor 122. In this regard, lug conveyors 148, 158 may be geared together so that for each lug 146 in the primary lane 110 there is a lug in the secondary lane 112 at the same downstream location. The motor/encoder may also return position signals to the processor.

A pair of brushes 172, 173 overlies the primary lane downstream of the diversion station 116 and another 174 overlies the secondary lane downstream of the diversion station.

In operation, where cards 30 are identical, they are simply stacked in stack 28 of card feeder 20. More typically, however, different cards carry different information and a particular batch of cards is intended to be affixed to a given carrier. In such instance, the cards are pre-sorted by batch and the batches stacked into stack 28. In this eventuality, the carriers need to appear on the carrier conveyor 42 in the same order as the card batches. This may be manually done, but it is more easily accomplished by feeding blank carriers and then printing a carrier with indicia which is dependent upon information read from one or more of the cards in a batch. Subject to machine errors, this ensures the carriers appear in the same order as the batches to which they relate. A system for printing carriers with indicia dependent upon information read from a card, and marrying the card with the related carrier is described in U.S. Pat. No. 5,538,232 to Long, the contents of which are incorporated by reference herein.

If not already applied, air pressure is communicated to the air supply lines. On start-up, this results in gate 120 being extended, upper conveyor 130 being retracted, and reciprocating lug support plate 162 being extended.

Processor activates motor 44 in order to move carriers 50 along carrier conveyor 42. Scanner 48 reads indicia from a carrier and outputs this to processor 70. This indicia indicates the number of cards that are to be affixed to the carrier. The processor then controls the motors 32, 34 of card feeder 20 and the motor/encorder 170 of apparatus 100 in order to singly feed the indicated number of cards from stack 28 along primary lane 110 of apparatus 100 as a batch of cards. The processor tracks the downstream progress of the batch of cards and of the related carrier.

Figure 4A:
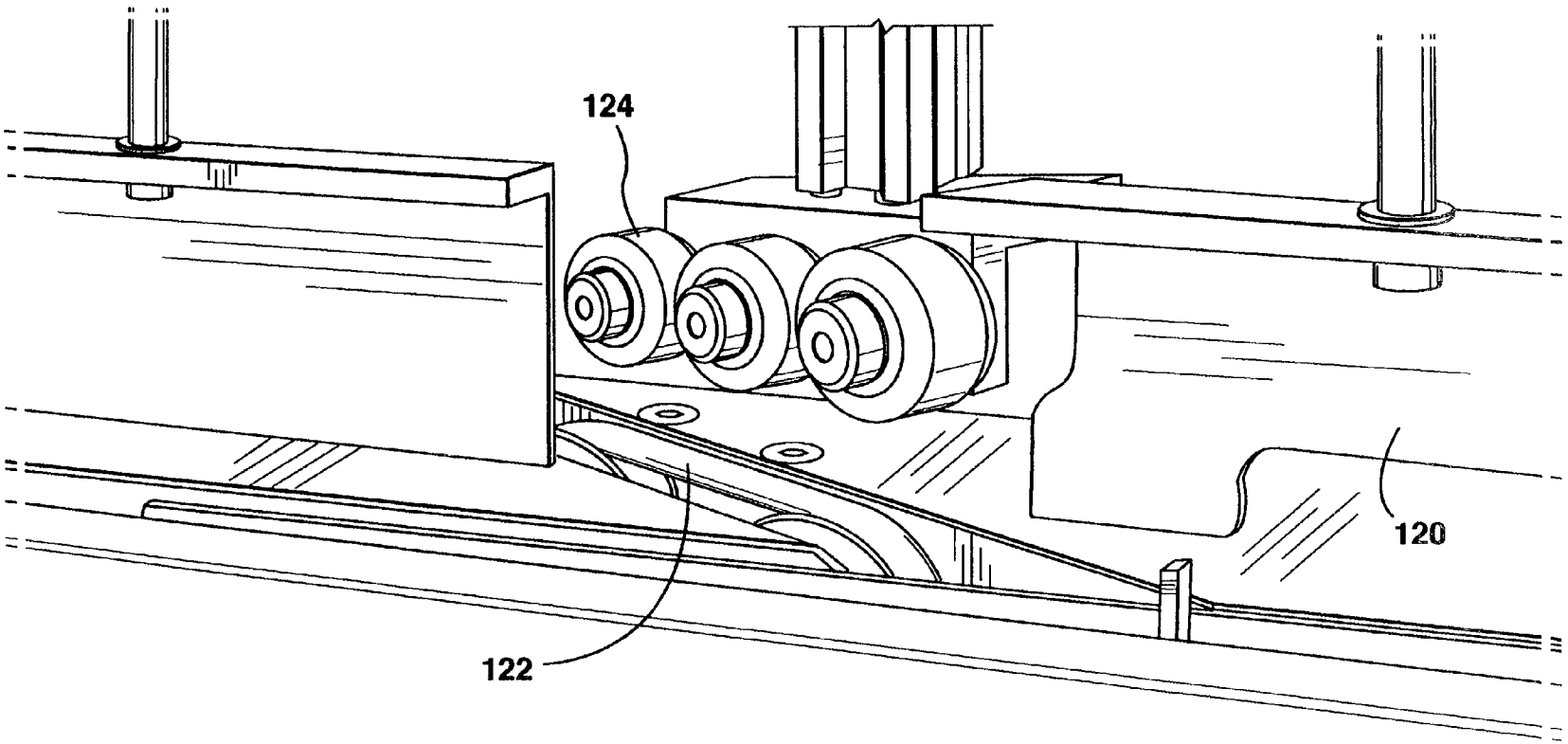

Assuming initially that each of a series of batches contains one card, the processor may feed a card to every second flight of the lug conveyor 148. As will be appreciated, a flight is defined by each adjacent pair of lugs 146 of lug conveyor 148. In this instance, the diversion station 116 is not used and the processor 70 keeps gate 120 down and upper conveyor 124 up while each card passes the diversion station, as shown in FIG. 4*a*. In consequence, although each card passing over lower conveyor 122 is urged toward the secondary lane 112, with the gate 120 down, the card simply butts up against the gate while it is moved further along the primary lane 110 by a lug 146. Further, the processor keeps the reciprocating lug support plate 162 extended and simply controls the speed of the lug conveyor 148 and carrier conveyor 42 so that a carrier reaches the marrying station 52 contemporaneously with the single card of the associated batch.

In order that a card will become affixed to a carrier at the marrying station 52, upstream of this station, as the carrier 50 passes glue guns 46, the processor controls the gun under the primary lane 110 to apply glue to an appropriate area of the carrier.

If each of a subsequent series of batches contains two cards, the processor may feed a card to every flight of the lug conveyor 148. Again, the diversion station is not used and the processor keeps the reciprocating lug support plate 162 extended. The processor controls the speed of the lug conveyor 148 and carrier conveyor 42 so that a carrier reaches the marrying station 52 contemporaneously with the two cards of the associated batch. Upstream of the marrying station 52, the processor controls the glue gun 46 under the primary lane 110 to deposit two areas of glue on a carrier so that the two cards of the batch will be affixed to the carrier at the marrying station.

Figure 6D:
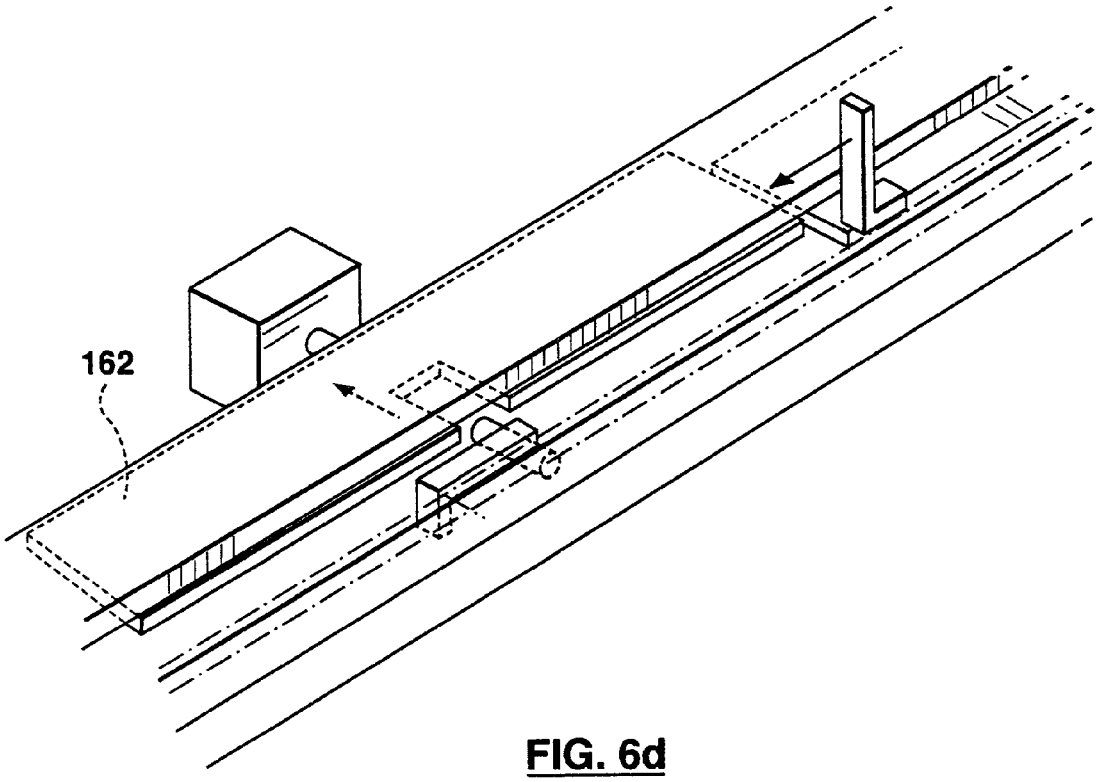
Figure 6E:
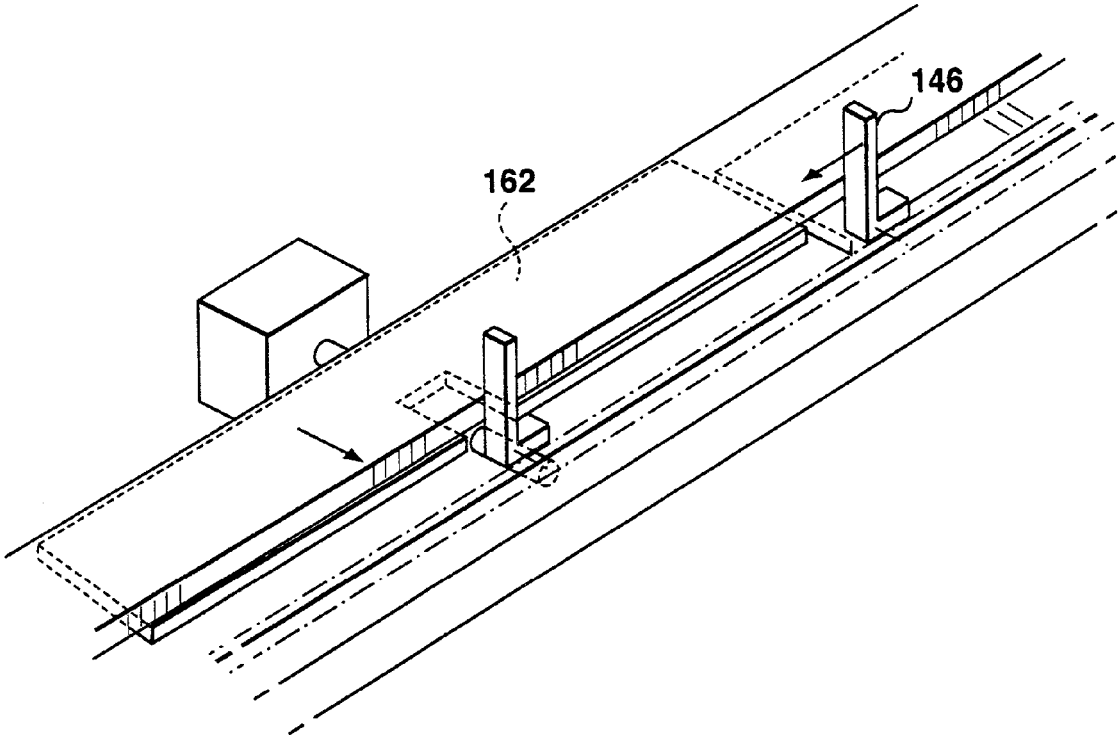

If each of a subsequent series of batches contains three cards, the processor may feed a card to the first three of every set of four adjacent flights of the lug conveyor 148. The processor allows the first two cards in the batch to pass the diversion station 116 but, as soon as the lug pushing the second of the first two cards is on reciprocating lug support plate 162, the processor retracts the lug support plate 162. Thus, retraction of the support plate causes the lugs 146 pushing the first two cards to drop from their erect position illustrated in FIGS. 6*a* and 6*c* to an inactive position illustrated in FIGS. 6*b* and 6*d*. In their inactive position, the lugs freely pass under the cards without pushing them. Furthermore, the brush 173 acts to decelerate and stop the lead card in the primary lane and brush 172 acts to decelarate and stop the second card in the primary lane. Thus, the brushes prevent over-travel of the cards in the primary lane. As lug conveyor 148 continues to operate, subsequent lugs fall off plate 160 as they pass the diversion station 116 and drop to an inactive position. Thus, with reciprocating lug support plate 162 retracted, cards that have passed the diversion station 116 cease to move downstream. Further, in view of the aforedescribed length constraints of plate 162, it will be apparent the processor can stop the cards so that the first card is downstream of peg 166 and the second card stops is upstream of the peg. It will be noted that even with the reciprocating lug support plate 162 retracted, lugs will momentarily be re-erected by peg 166.

Figure 4B:
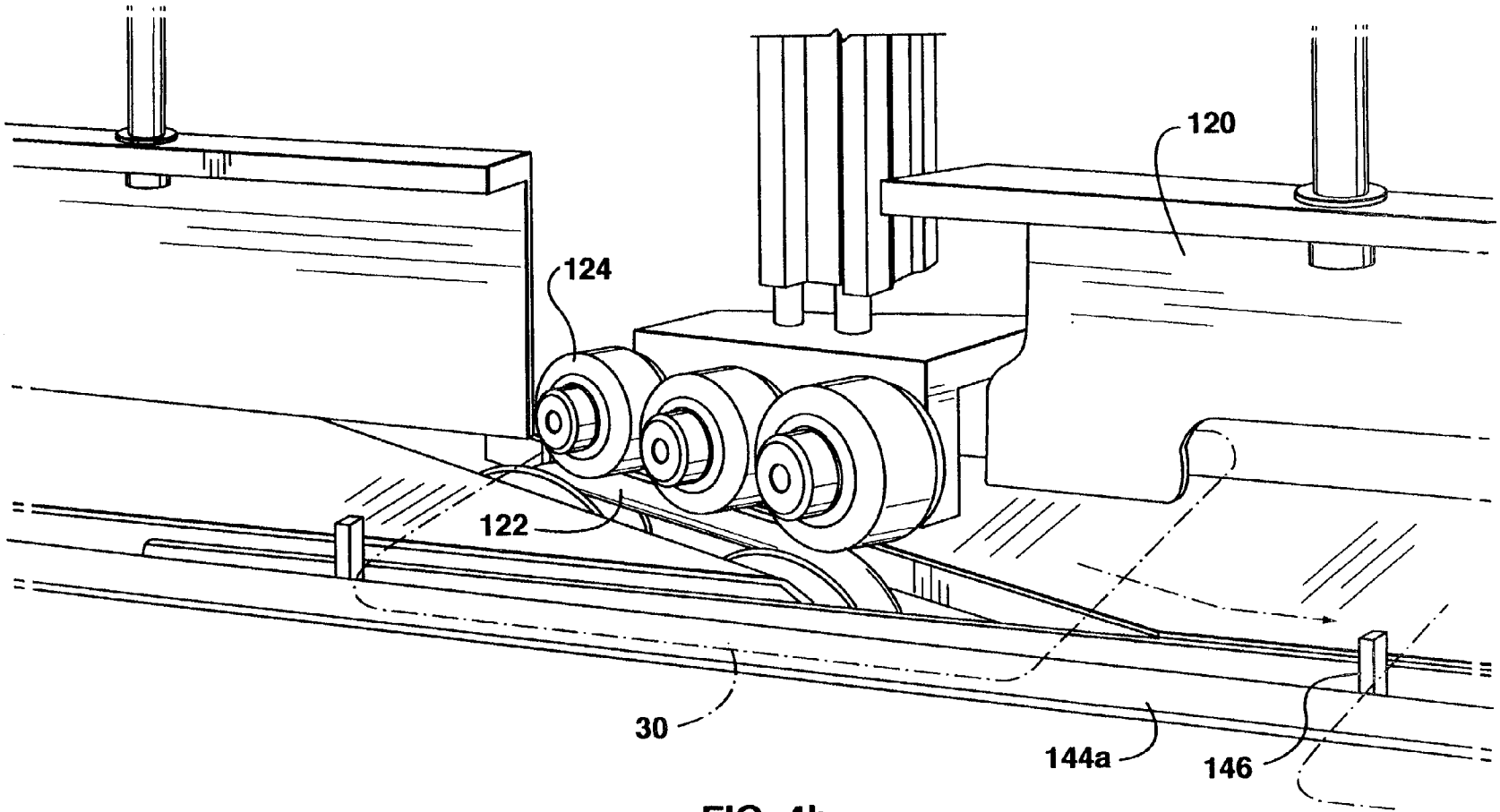
Figure 5:
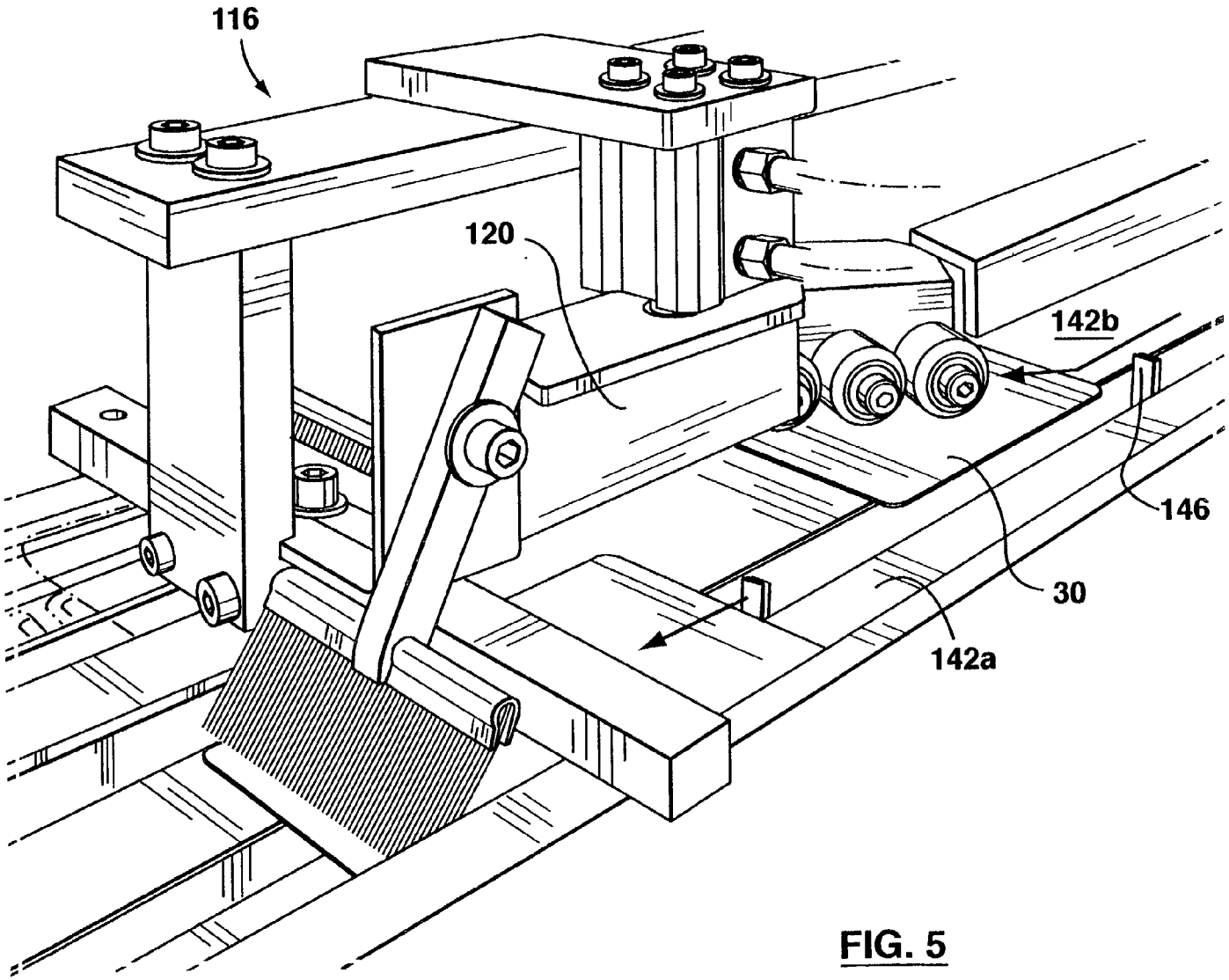
FIG. 5 is a perspective view of a portion of the apparatus of FIG. 3 illustrating its operation.

As soon as the second card in the batch passes the diversion station, the processor retracts gate 120 and extends upper conveyor 124 so that it nips lower conveyor 122, as shown in FIG. 4*b*. In consequence, the third card of the batch will be entrained in the nip between conveyors 122, 124 and will be pulled on a bias from the primary lane 110 to the secondary lane 112. In this regard, the lower conveyor 122 may be geared to the lug conveyor 148 to move at a higher speed than lug conveyor 148 so that it will pull a card away from the lug 146 that is pushing it in the primary lane 110. The higher speed of the lower conveyor may also be used to position the diverted card downstream of a lug in the secondary lane that parallels the lug that was pushing the card along the primary lane. The brush 174 in the secondary lane keeps the third card of the batch under control during the lane transfer.

When the lug pushing the diverted card along the secondary lane is at the downstream location of the peg 166 of the primary lane, a corresponding lug in the primary lane will be erected by peg 166. As aforenoted, the length of the plate 162 is chosen so that at this moment no other lug in the primary lane is at the downstream location of the plate 162. Accordingly, at this moment the processor can extend the reciprocating lug support plate 160 without interference from any dropped lug. Lugs in the primary lane will therefore again remain erect. Hence, the lug in the primary lane paralleling the lug pushing the diverted card will encounter the first card of the batch which had stopped downstream of peg 166. Thus, the first and third cards in the batch will be side-by-side and will move downstream together with the second card trailing, moving downstream behind the first card. (Alternatively, plate 162 may be extended when the lug in the secondary lane that is immediately downstream of the lug pushing the third card of the batch is adjacent peg 166. In this instance, the second and third cards in the batch will be side-by-side and will move downstream together with the first card leading, moving downstream in front of the second card.)

The processor controls the speed of the lug conveyors 148, 158 and carrier conveyor 42 so that a carrier reaches the marrying station 52 contemporaneously with the three cards of the associated batch. Upstream of the marrying station 52, the processor controls the glue gun 46 under the primary lane 110 to deposit two areas of glue on a carrier and the glue gun 46 under the secondary lane 112 to deposit one area of glue on the carrier. This allows the three cards of the batch to be affixed to the carrier at the marrying station.

As soon as the third card passes the diverting station, the processor again extends gate 120 and retracts upper conveyor 124 so that the diversion station will be by-passed by the first card(s) of the next batch.

If each of a subsequent series of batches contains four cards, the processor may feed a card to all four of every set of four adjacent flights of the lug conveyor 148. Again, the processor allows the first two cards in the batch to pass the diversion station 116 but, as soon as the first card in the batch moves just past peg 166, the processor retracts the lug support plate 162 so that these first two cards stop.

Figure 2A:
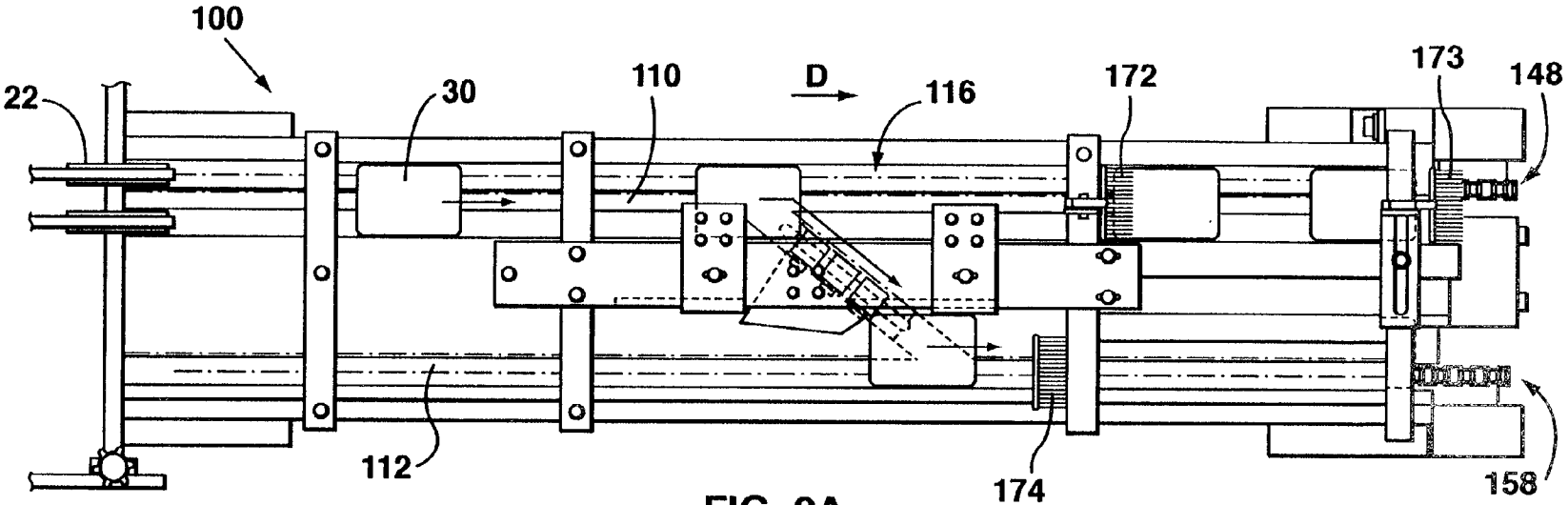
FIGS. 2A and 2B are plan views of a portion of the system of FIG. 1 illustrating its operation.

As soon as the second card in the batch passes the diversion station, the processor retracts gate 120 and extends upper conveyor 124 so that it nips lower conveyor 122. In consequence, the third card of the batch will be entrained in the nip between conveyors 122, 124 and will be pulled on a bias from the primary lane 110 to the secondary lane 112 in front of a lug paralleling the lug that was pushing the third card in the primary lane. This is illustrated in FIG. 2A. As the fourth card reaches the diverting station 116, it too is diverted to the secondary lane in similar fashion.

Figure 2B:
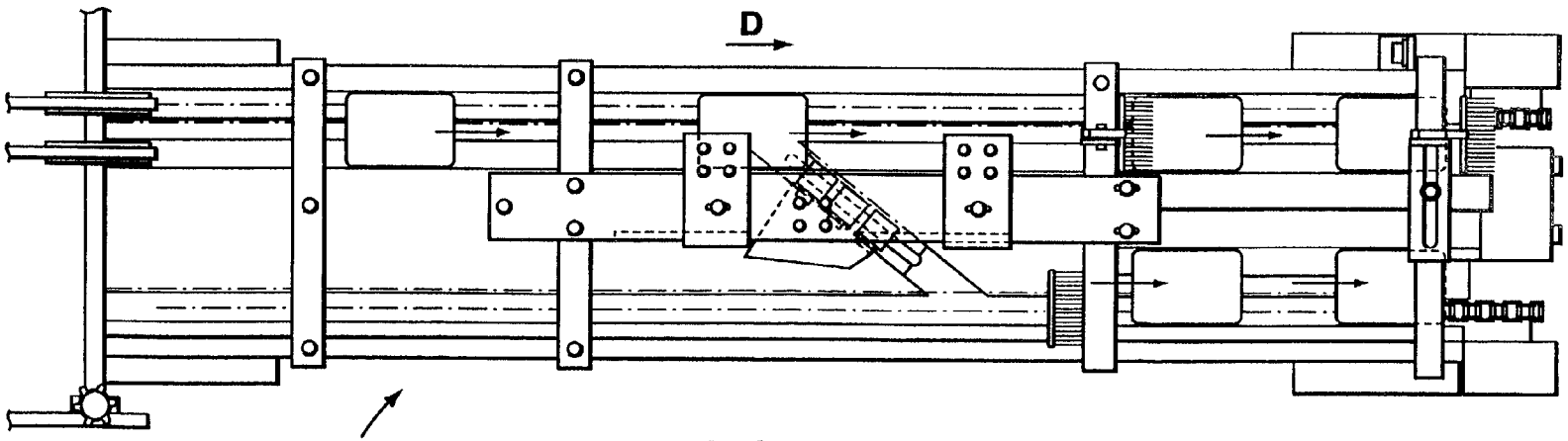
Figure 3:
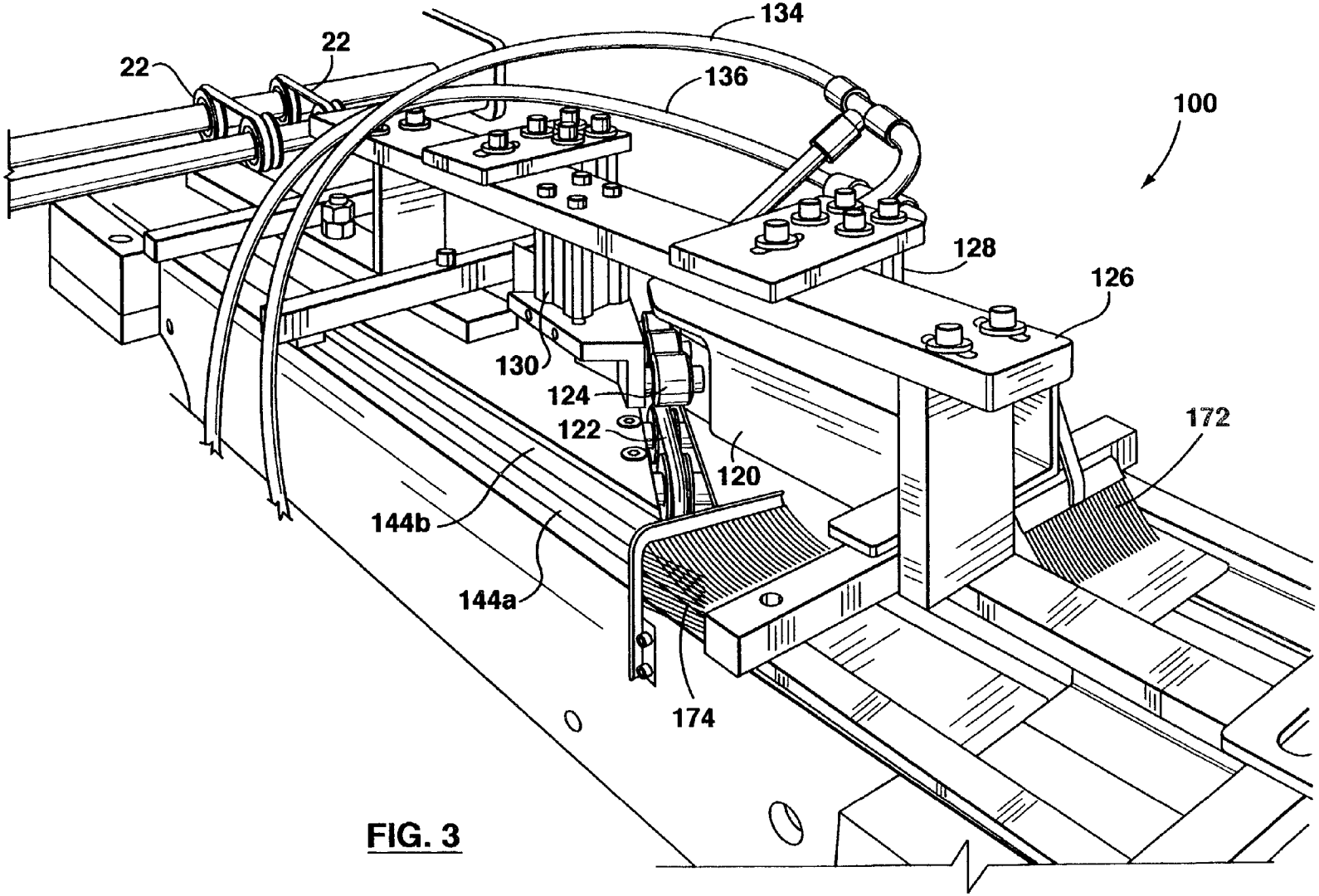
FIG. 3 is a perspective view of the apparatus of FIGS. 2A and 2B, FIGS. 4*a* and 4*b* are perspective views of a portion of the apparatus of FIG. 3 illustrating its operation.

When the lug of the secondary lane pushing the third card in the batch—which is the first diverted card—is at the downstream location of the peg 166 of the primary lane, a corresponding lug in the primary lane will be erected by peg 166. At this moment the processor can extend the reciprocating lug support plate 162 and the lug in the primary lane paralleling the lug pushing the first diverted card will encounter the first card of the batch which had stopped downstream of peg 166. Similarly, the second card in the batch will be pushed by a lug paralleling the second diverted card (which is the last card in the batch). This result is shown in FIG. 2B.

The processor controls the speed of the lug conveyors 148, 158 and carrier conveyor 42 so that a carrier reaches the marrying station 52 contemporaneously with the four cards of the associated batch. Upstream of the marrying station 52, the processor controls the glue gun 46 under the primary lane 110 to deposit two areas of glue on the carrier and the glue gun 46 under the secondary lane 112 to deposit another two areas of glue on the carrier. This allows the four cards of the batch to be affixed to the carrier at the marrying station.

The processor has been described as tracking the progress of cards and carriers through control of motor/encoder 170 and motor 44 with feedback from the encoder of motor/encoder 170 and scanner 48. Tracking can equally be accomplished with appropriate positioned sensors associated with apparatus 100 and carrier conveyor system 40.

While the secondary lane has been shown as having a length similar to that of the primary lane, it could be much shorter, commencing only at the diverting station.

While the operation of a reciprocating plate 162 (with brushes 171, 172) has been described as the manner of stopping cards in the primary lane, alternatively other approaches may be used. For example, lugs could have electromagnets to pull them to an erect or an inoperative position as dictated by the processor in order to achieve the aforedescribed operation of the lugs.

Optionally, an appropriate sensor (such as an optical character reader, magnetic stripe reader, or a bar code reader) may be positioned on the lug conveyor 148 to read cards fed by feeder 20 and output to processor 70 so that the processor can check the cards are in their intended order (i.e., the cards of a batch are, indeed, intended for the associated carrier).

Other modifications will be apparent to those skilled in the art and, therefore, the invention is defined in the claims.

What is claimed is:

1. A method of marrying cards with carriers, comprising:

singly feeding cards along a primary lane so as to feed a batch of cards along said primary lane, said batch of cards comprising a first number of cards;

selectively diverting cards from said primary lane to a secondary lane so as to divert from said batch of cards a second number of cards, said second number of cards being less than said first number of cards;

affixing cards from said primary lane and from said secondary lane to a carrier so that each card of said batch of cards is affixed to said carrier;

wherein said selectively diverting comprises selectively raising a gate between said primary lane and said secondary lane.

2. The method of claim 1 wherein said selectively diverting further comprises running a conveyor on a bias between said primary lane and said secondary lane at the downstream location of said gate.

3. The method of claim 2 wherein said conveyor is a lower conveyor and said selective diverting further comprises extending an upper conveyor that runs on a bias between said primary lane and said secondary lane into nipping relation with said lower conveyor when said gate is raised and retracting said upper conveyor when said gate is lowered.

4. The method of claim 1 wherein said first number is four and said second number is two.

5. The method of claim 1 wherein said first number is three and said second number is one.

6. A method of marrying cards with carriers, comprising:

singly feeding cards along a primary lane so as to feed a batch of cards along said primary lane, said batch of cards comprising a first number of cards;

selectively diverting cards from said primary lane to a secondary lane so as to divert from said batch of cards a second number of cards, said second number of cards being less than said first number of cards;

affixing cards from said primary lane and from said secondary lane to a carrier so that each card of said batch of cards is affixed to said carrier;

wherein said cards are fed by lugs of said primary lane and by lugs of said secondary lane.

7. The method of claim 6 wherein each adjacent pair of lugs of said primary lane defines a flight and wherein when said first number is one and said second number is zero, a card is fed to every second flight of said primary lane, when said first number is two and said second number is zero, a card is fed to every flight of said primary lane, when said first number is three and said second number is one, a card is fed to two of every three lugs of said primary lane, and when said first number is four and said second number is two, a card is fed to every flight of said primary lane.

8. The method of claim 6 wherein said selective diverting leaves a third number of cards in said primary lane, wherein said diverting is accomplished at a diverting station, and wherein, after said third number of cards passes said diverting station, lugs pushing said third number of cards are dropped so that said third number of cards stops while said second number of cards are diverted to said secondary lane.

9. The method of claim 8 further comprising re-erecting dropped lugs of said primary lane after said second number of cards are diverted to said secondary lane.

10. The method of claim 9 wherein said lugs are dropped by retracting a moveable plate that holds said lugs erect.

11. The method of claim 1 further comprising:

reading an indication of said first number of cards to feed to said primary lane.

12. The method of claim 11 wherein said reading comprises reading from said carrier.

13. A method of marrying cards with carriers, comprising:

singly feeding cards along a primary lane so as to feed a batch of cards along said primary lane, said batch of cards comprising one or more leading cards followed by one or more trailing cards;

diverting said trailing cards from said primary lane to a secondary lane while arresting feeding of all of said leading cards along said primary lane;

affixing cards from said primary lane and from said secondary lane to a carrier so that each card of said batch of cards is affixed to said carrier.

14. The method of claim 13 wherein said diverting comprises raising a gate between said primary lane and said secondary lane after said leading cards have passed said gate.

15. The method of claim 14 wherein said selectively diverting further comprises running a conveyor on a bias between said primary lane and said secondary lane at the downstream location of said gate.

16. The method of claim 15 wherein said conveyor is a lower conveyor and said selective diverting further comprises extending an upper conveyor that runs on a bias between said primary lane and said secondary lane into nipping relation with said lower conveyor when said gate is raised and retracting said upper conveyor when said gate is lowered.

* * * * *